United States Patent [19]

Brown et al.

[11] Patent Number: 4,770,159

[45] Date of Patent: Sep. 13, 1988

[54] FIREBACK SUPPORT APPARATUS

[76] Inventors: Richard Brown; James D. Conner, both of Delrich, Inc., P.O. Box 44, Rydal, Pa. 19046

[21] Appl. No.: 120,978

[22] Filed: Nov. 16, 1987

[51] Int. Cl.[4] ..... F24B 13/00

[52] U.S. Cl. ..... 126/130; 126/141; 126/152 B; 126/164; 126/298

[58] Field of Search ..... 126/298, 120, 121, 141, 126/138, 130, 164, 152 R, 152 A, 152 B, 202, 201; 160/368 R, DIG. 9; 248/DIG. 11, DIG. 12, 188

[56] References Cited

U.S. PATENT DOCUMENTS

| | | | |
|---|---|---|---|
| 239,873 | 4/1881 | Southward | 126/141 |
| 365,632 | 6/1887 | Read | 126/164 |
| 2,408,935 | 10/1946 | Kunst | 126/165 |
| 4,688,548 | 8/1987 | Stroughton | 126/298 |

FOREIGN PATENT DOCUMENTS

| | | | |
|---|---|---|---|
| 107118 | 6/1917 | United Kingdom | 126/164 |
| 130524 | 8/1919 | United Kingdom | 126/164 |

*Primary Examiner*—James C. Yeung
*Attorney, Agent, or Firm*—Z. T. Wobensmith, III

[57] ABSTRACT

Fireback support apparatus for supporting a fireback in a fireplace or other area, which does not require attachment to a wall and which provides for varying the angle with respect to the vertical of the fireback. The apparatus includes two base members with flat horizontal surfaces with two vertical upright rear walls, with a transverse opening therebetween and a plurality of steps onto which a fireback is placed for elevational and angular position. Each of the base members also has an opening in the horizontal surface of the upright portion into which legs from a grate may be placed.

3 Claims, 1 Drawing Sheet

FIREBACK SUPPORT APPARATUS

BACKGROUND OF THE INVENTION

1. Field of the Invention

This invention relates to fireback support apparatus of the type which elevates the fireback and permits variance of the angle of the fireback with the vertical plane.

2. Description of the Prior Art

The use of firebacks for decoration, increasing heat radiation and protection of the fireplace rear wall is well known in the art. The configurations of fireplaces are often dissimilar and particularly the angularity of the rear wall and the levelness of the hearth. It has been considered desirable to provide apparatus that not only holds the fireback at a desired angle but also supports the logs and is useful on uneven hearths. The U.S. Pat. No. 59,968 to Coate discloses a portable fire grate and andirons, which include side bars, a grate and a back plate. Rotation of the grate above the hearth and the grate is possible to change the angle of the back plate. This apparatus is very limited in use in that the back plate is fixed to the side bars, and in order to change the angle of the back plate the side bars and grate must be raised above the hearth which is both awkward and dangerous. The U.S. Pat. No. 757,595 to Bostel discloses a combined back plate and grate which is pivotally supported, and can be rotated to change the angle of the back plate. This apparatus suffers from the same drawbacks as that of Coate.

The U.S. Pat. No. 979,195 to Parrish discloses a fireback and andirons for a fireplace but has no provisions for verying the angle of the fireback.

The U.S. Pat. No. 2,578,564 to Love et al. discloses a log fireplace apparatus with andirons and provisions for changing the retention of logs placed on the andirons but does not disclose a fireback or any structure useful for fireback support.

The U.S. Pat. No. 4,526,159 to Vroome discloses a fireplace grate that includes a base, an inclined back wall detachably connected to the base, and an inclined wire grill that is detachably connected to the base and adjustable relative to the back wall. The back plate is not adjustable, for angle variation which limits the usefulness of the device.

The U.S. Patent No. 4,688,548 to Stoughton discloses a holder apparatus for a fireback, which includes two support bases, with buttresses and a fireback retained therebetween. The angularity of the fireback can be varied by placing wedges in the gap between the butresses. This apparatus requires a large number of parts, is not satisfactory on uneven floors and suffers from other problems.

The fireback support apparatus of the invention does not suffer from the problems of the prior art structures and provides many positive advantages.

SUMMARY OF THE INVENTION

In accordance with the invention a fireback support apparatus is provided to hold a fireback elevated above the hearth at a desired angle. The fireback holder apparatus includes two base members of rectangular shape, each with four legs, an upper surface and two separated vertical rear walls, the rearmost wall being provided with a plurality of steps onto which the fireback is placed and which fireback then can span the fireplace rear wall. The base members each have a hole in the upper surface in front of the rear walls into which a leg from a grate may be placed. The grate supports logs for burning and also helps to hold the base members in position.

The principal object of the invention is to provide fireback support apparatus that elevates and also positively supports the fireback at a desired angular position.

A further object of the invention is to provide fireback support apparatus which can be used on an uneven hearth surface.

A further object of the invention is to provide fireback support apparatus that can be easily assembled and disassembled.

A further object of the invention is to provide fireback support apparatus that is sturdy and reliable in use, and enjoys a long service life.

A further object of the invention is to provide a fireback support apparatus that has a minimum of components.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
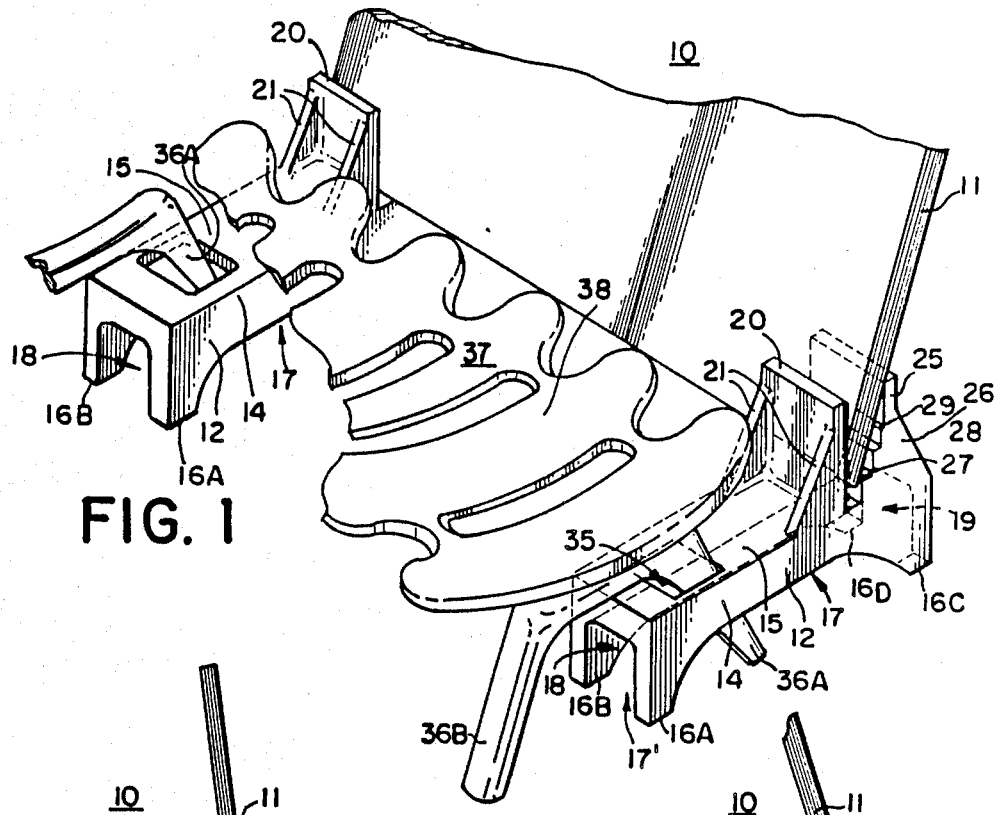
FIG. 1 is a view in perspective of the fireback support apparatus in accordance with the invention and with the fireback inclined towards the rear.
Figure 2:
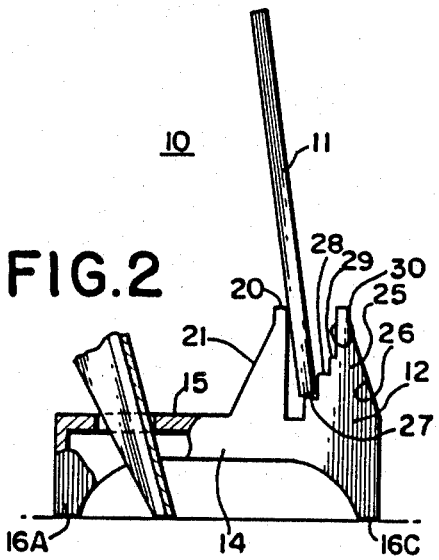
FIG. 2 is a right side view in partial section and reduced scale of the apparatus of FIG. 1, with the fireback in a forwardly inclined position.
Figure 3:
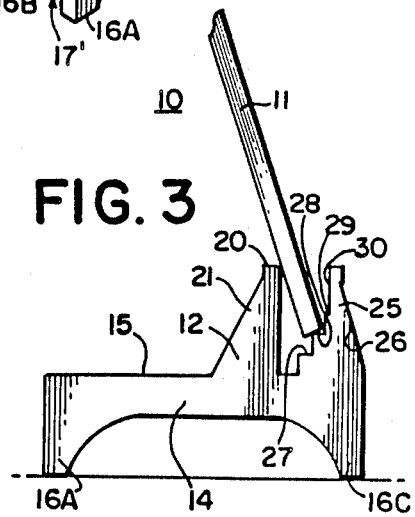
FIG. 3 is a view similar to FIG. 2, but with the fireback in another position.
Figure 4:
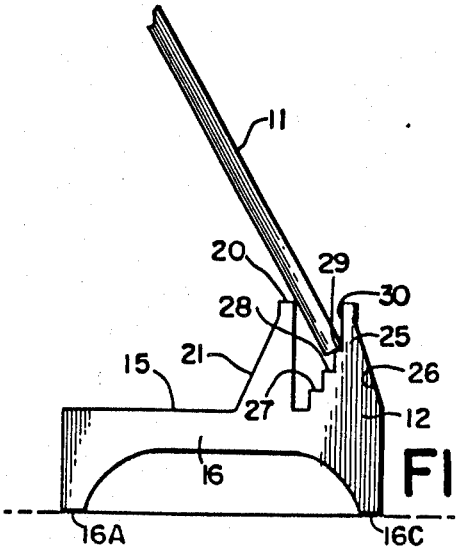
FIG. 4 is a view similar to FIG. 3 but with the fireback in still another position.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and the FIGS. thereof, the fireback support apparatus 10 includes a fireback 11 of well known type which is of generally rectangular shape. The fireback 11 can be provided with a design or be blank as desired, is preferably formed of cast iron and usually made in a size range of 18 to 20 inches wide, and 18 to 21 inches high. A pair of base members 12 are provided of generally rectangular configuration, with a center portion 14, which has a flat upper surface 15 and with four leg portions 16A, 16B, 16C and 16D at the corners thereof extending downwardly from the center portion 14 for engagement with a hearth (not shown).

Th leg portions 16A, 16B, 16C and 16D are curved to form arch configurations 17 and 17' as seen from the side and with spaces 18 and 19 between leg portions 16A, 16B, 16C and 16D. The spacing and configuration of the leg portions 16A, 16B, 16C and 16D permits the base members 12 to be supported on an uneven surface without adverse effect on the support provided by the base members.

The center portion 14 at the rear of the base member 12 has a first rear wall 20 extending vertically upwardly therefrom, with a pair of triangularly shaped walls 21 in front and integral therewith, and with the surface 15 providing bracing to the wall 20. A second rear wall 25 is provided also extending vertically upwardly from surface 14 and spaced rearwardly from wall 20. The wall 25 has a pair of triangularly shaped walls 26 integral therewith and with surface 15 to provide bracing thereto.

The rear wall 25 is provided with a plurality of steps 27, 28, and 29 and a vertical flat surface 30 above step 29.

As illustrated, the walls 20 and 25 are of the same height.

The surface 15 in front of wall 20 is provided with an opening 35 of rectangular configuration that extends across the base members 12. The base members 12 are preferably formed of cast iron but any suitable material of sufficient weight and heat resistance can be used as desired. Legs 36A from a grate 37 which is of triangular configuration are shown in openings 35, and which are part of a pair of legs 36 and 36B, which are part of grate 37. The grate 37 also has a log supporting section 38, which spans legs 36A and 36B and is fastened thereto.

The grate 37 is of known type and is also preferably formed of cast iron.

The mode of operation and use will now be pointed out.

In operation the base members 12 are placed on a hearth (not shown) at a distance dictated by the width of the fireback to be supported. The fireback 11 is placed between the rear walls 20 and 25 on one of the steps 27, 28 or 29 depending on the desired elevation of the fireback 11 and inclined forwardly or rearwardly as desired. The legs 36A are inserted in openings 35 of base members 12 if desired, and logs (not shown) may be placed on grate 37 and used as desired.

It will thus be seen that fireback holder apparatus has been provided in accordance with the objects of the invention.

We claim:

1. Fireback holder apparatus for supporting and orienting a fireback in a fireplace having a rear wall which comprises:

at least two base members, said base members each having a center portion, a front and rear pair of leg members extending from said center portion for support of said base members, said center portion has an upper surface, spaced apart first and second rear walls adjacent said rear leg members extending vertically upwardly from said upper surface, and said second wall has a plurality of vertical steps to support and elevate said fireback in a variety of angularly related upright positions to accommodate the fireplace rear wall configuration.

2. Fireback holder apparatus as defined in claim 1 in which said upper surface of each of said base members in front of said first wall has a transverse opening therethrough, and a grate having a plurality of legs at least one of which may be inserted in said opening in said upper surface to restrain movement of said bases.

3. Fireback holder apparatus as defined in claim 2 in which said fireback, said base members and said grate are of cast iron.

* * * * *